United States Patent [19]

Pobuda et al.

[11] 4,251,062

[45] Feb. 17, 1981

[54] IGNITION HOOD WITH SWIRL COMBUSTION CHAMBER

[75] Inventors: Erhard Pobuda, Kelkheim; Alois Kilian, Frankfurt am Main, both of Fed. Rep. of Germany

[73] Assignee: Dravo Corporation, Pittsburgh, Pa.

[21] Appl. No.: 889,356

[22] Filed: Mar. 23, 1978

[30] Foreign Application Priority Data

Mar. 24, 1977 [DE] Fed. Rep. of Germany ..... 2712989

[51] Int. Cl.[3] ..... C22B 1/20

[52] U.S. Cl. ..... 266/178; 75/5; 432/237; 432/246; 431/182; 431/351

[58] Field of Search ..... 266/177, 178, 179, 180, 266/181, 140; 75/5; 432/137, 146; 431/182, 185, 351-353

[56] References Cited

U.S. PATENT DOCUMENTS

| | | | |
|---|---|---|---|
| 2,112,887 | 4/1938 | Greenwalt | 75/5 |
| 3,179,391 | 4/1965 | Connell | 266/178 |
| 3,244,507 | 4/1966 | Linney | 75/5 |
| 3,260,513 | 7/1966 | Connell | 266/178 |
| 3,318,590 | 5/1967 | Winterling | 266/178 |
| 3,522,938 | 8/1970 | Greaves et al. | 266/180 |
| 4,014,639 | 3/1977 | Froehlich | 431/182 |

OTHER PUBLICATIONS

Cappell, F., "Die Zündung Von Sintermischungen", *Stahl U. Eisen*, vol. 94, Nr. 11, 5/23/74, pp. 453-461.

*Primary Examiner*—Michael L. Lewis

*Attorney, Agent, or Firm*—Parmelee, Miller, Welsh & Kratz

[57] ABSTRACT

A process for the ignition of sinter mixtures containing solid fuels and apparatus for carrying out this process. The ignition is effected by means of hot combustion gases which are produced, under certain specified conditions, by the combustion of gaseous or liquid fuel initially in a swirl combustion chamber and then under a hood from where they are suctioned through the sinter mix.

3 Claims, 5 Drawing Figures

IGNITION HOOD WITH SWIRL COMBUSTION CHAMBER

In the sintering of metal ores, the sintering rate and the quality of the finished sinter are highly dependent on the way in which the solid fuel in the sinter mixture is ignited. In the case of oxide iron ores, having to be supplied with the fuel required for sintering in the form of coke fines, the coke consumption also depends on conditions under which ignition is carried out. It is, therefore, obvious that the success of the overall sintering operation depends on the ignition process.

It is the purpose of the present invention to provide a new and improved process for the uniform ignition of the sinter mixture so that desirable results in the context of the quality of the finished sinter, the sintering rate, and coke fine consumption can be obtained. It is a further object of this invention to provide apparatus whereby this process can be carried out.

The invention is illustrated in the accompanying drawings, in which.

Figure 3A:
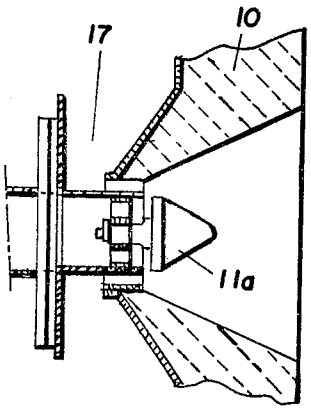
FIG. 3 is a cross-section through a combustion chamber with an oil diffusion burner.

FIG. 3*a* is a gas jet for a combustion chamber; and

Figure 4:
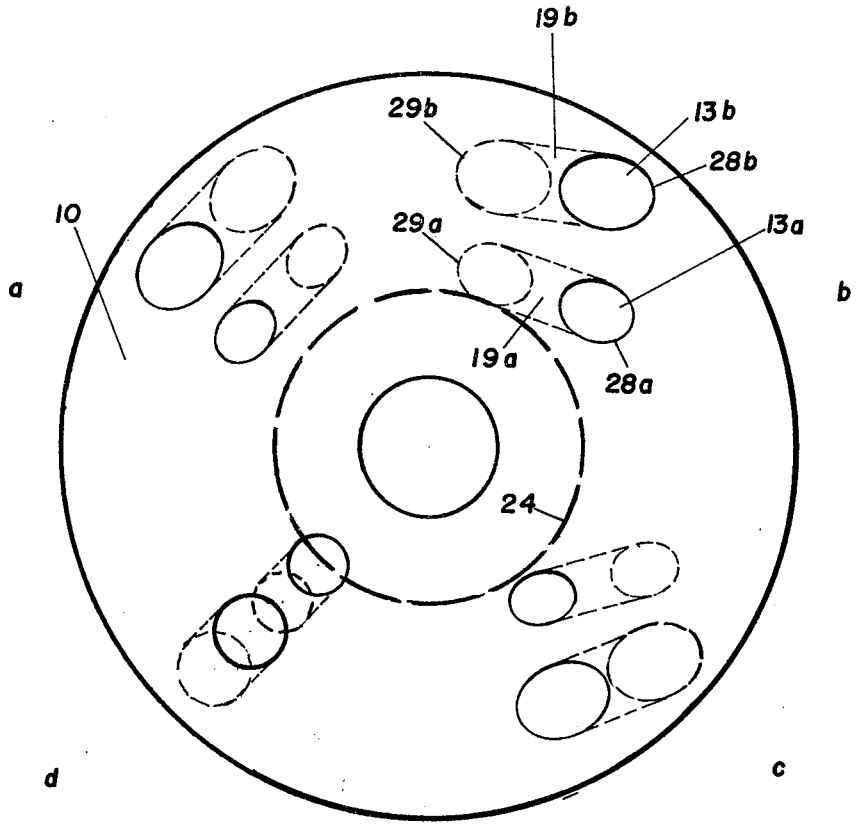

FIG. 4 is a view of a portion of a combustion chamber which illustrates several possible arrangements for the intake orifices for the oxidized gases within the rear wall plate of a combustion chamber.

It is known in the art that sinter mixtures containing solid fuels can be ignited by hot combustion gases which are suctioned through the sinter mix and which are produced by the burning of gaseous or liquid fuels under a combustion hood which covers a portion of the sintering strand, known as the ignition zone, on a continuous strand sintering machine.

It is also known that desirable ignition results are obtained if a quantity known as oxygen utilization ($\eta O_2$), which is equal to the oxygen content at measured air number over maximum possible oxygen at the adiabatic hood temperature, is approximately 1. According to this invention, further progress toward the achievement of optimum results can be obtained if, while the oxygen utilization of the gaseous or liquid fuels in the ignition zone of the hood is maintained at an average of above 0.9, the gaseous or liquid fuels are, before being introduced to the hood, first introduced to combustion chambers where they are mixed and fired with oxidized gases under conditions where swirl is generated. It has, further, been determined that particularly desirable results can be achieved if the rate of combustion in the combustion chambers is so controlled that at least 30% of the gaseous and/or liquid fuel is consumed at that point.

For the purpose of this description, the ignition zone of the hood extends along the sinter strand to that point where the surface temperature of the sinter mixture corresponds approximately to the temperature of the combustion gases passed into the hood. If the hood is designed strictly as an ignition hood, it will end shortly after this point. The hood may, however, also be designed as a combination ignition and heat treatment furnace. In such an event the hood will extend beyond the ignition zone.

The combustion chambers are connected to the hood, and the mixing of the fuel and oxidizing gas takes place therein in a manner in which one medium is introduced centrally and the other is swirled around the centrally introduced medium. Oxygen-containing gases which may be used are air, hot gases returned from the sinter machine, or oxygen enriched gases.

This process may be carried out by a device which consists of a continuous grate sintering machine in which the combustion chambers are emplaced along the side walls of the hood at least over the length of the ignition zone. These combustion chambers may be constructed so that within their rear wall plates, which should be constructed of a refractory material, there is a feeding device for fuel or oxidizing gas and around this central feeding device intake orifices for fuel or oxidizing gas are swirl arranged so that their axes do not intersect with the longitudinal axis of the combustion chamber.

It is expedient to arrange the combustion chambers along the two long walls of the hood. It is also noted that the arrangement may be offset. The central feeder device is generally used for the supply of fuel, in which case it may be designed as a gas jet or a spray diffuser with a conical enlargement for liquid fuels. It is also preferable that the combustion chambers be round in shape and that they should be constructed with a double casing through which the oxidizing gas is fed. In this way the gas serves as a cooling agent for the combustion chamber and is simultaneously heated.

In a preferred embodiment of this apparatus, two rows of intake orifices are arranged around the central feeding device, and at least one row of these intake orifices is swirl arranged. The two rows may be arranged with differing swirl in relation to each other and may have different diameters. It is also preferable that the rows of intake orifices be arranged in a circle around the central feeding area.

In another preferred embodiment, turnable discs with seals are emplaced over at least one row of the circularly arranged intake orifices so that individual intake orifices may be closed and thereby increase the rate of flow through the other orifices.

Figure 1:
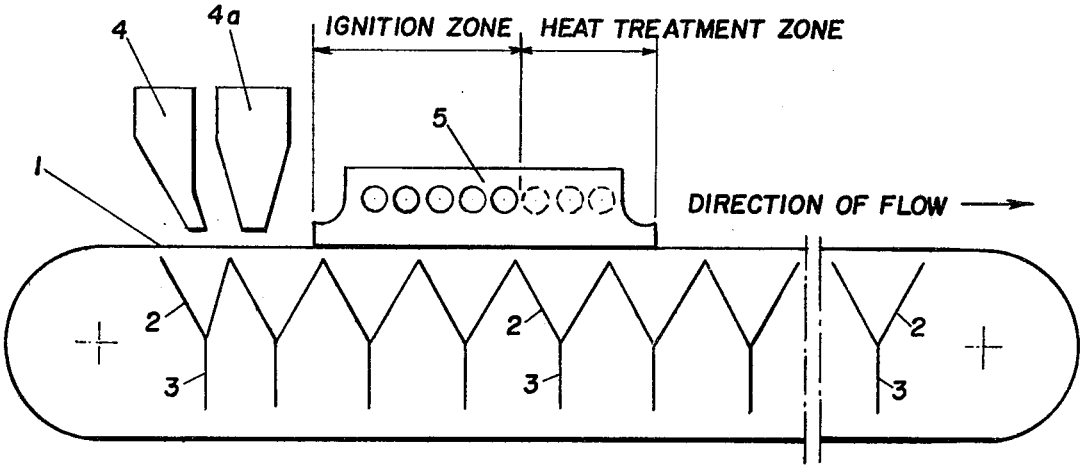
FIG. 1 is a schematic diagram of a sinter machine.

The present invention is further disclosed by FIG. 1 in which wind boxes 2 and exhaust gas lines 3 are arranged below the traveling grate 1. The center part of the sintering machine is not shown. From bunker 4 the grate coating and from bunker 4*a* the sinter mix are loaded onto the traveling grate 1. The hood 5 has an ignition zone and a heat treatment zone. Within the ignition zone the fuel in the top layer of the sinter mix is ignited. In the heat treatment zone hot gases are fed into the sinter mix after ignition. After passing under the hood, ambient air is suctioned through the sinter mix.

Figure 2:
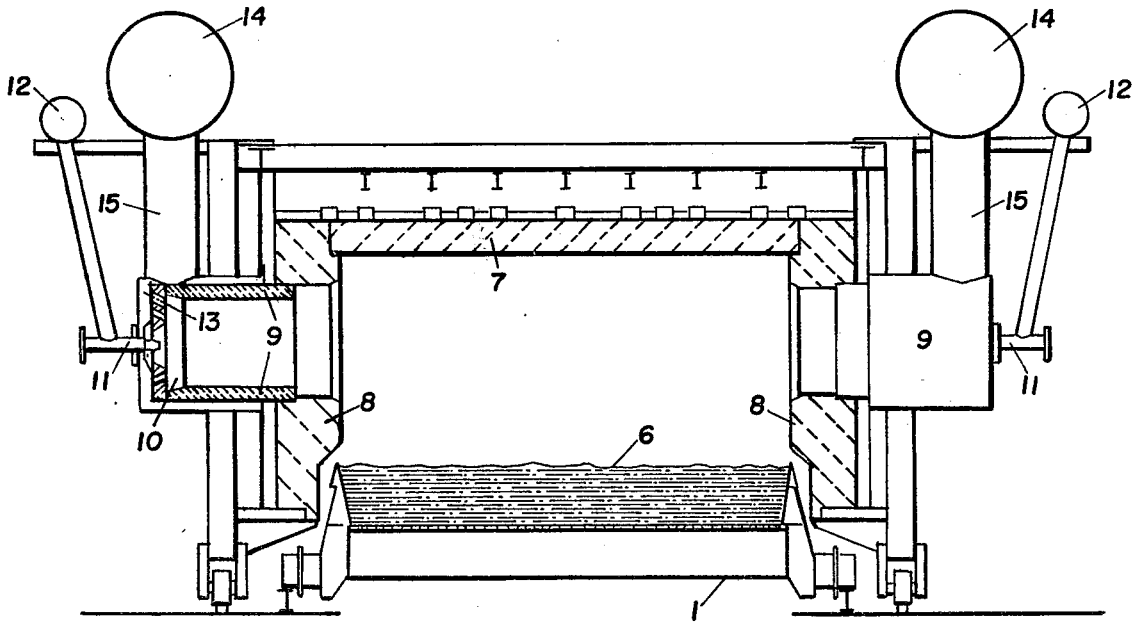
FIG. 2 is a cross-section through a hood with a combustion chamber.

Referring to FIG. 2, the sinter mix 6 rests on the traveling grate 1. The hood 5 consists of the suspended ceiling 7 and the sidewalls 8. Within the fireproof rear wall 10 of each combustion chamber there is a central fuel jet 11 which receives its fuel from the fuel distribution line 12. Arranged around the fuel nozzle 11 are intake orifices 13 in a swirl pattern for oxidizing gases, which are fed from the air distribution lines 14 via connecting lines 15.

Figure 3:
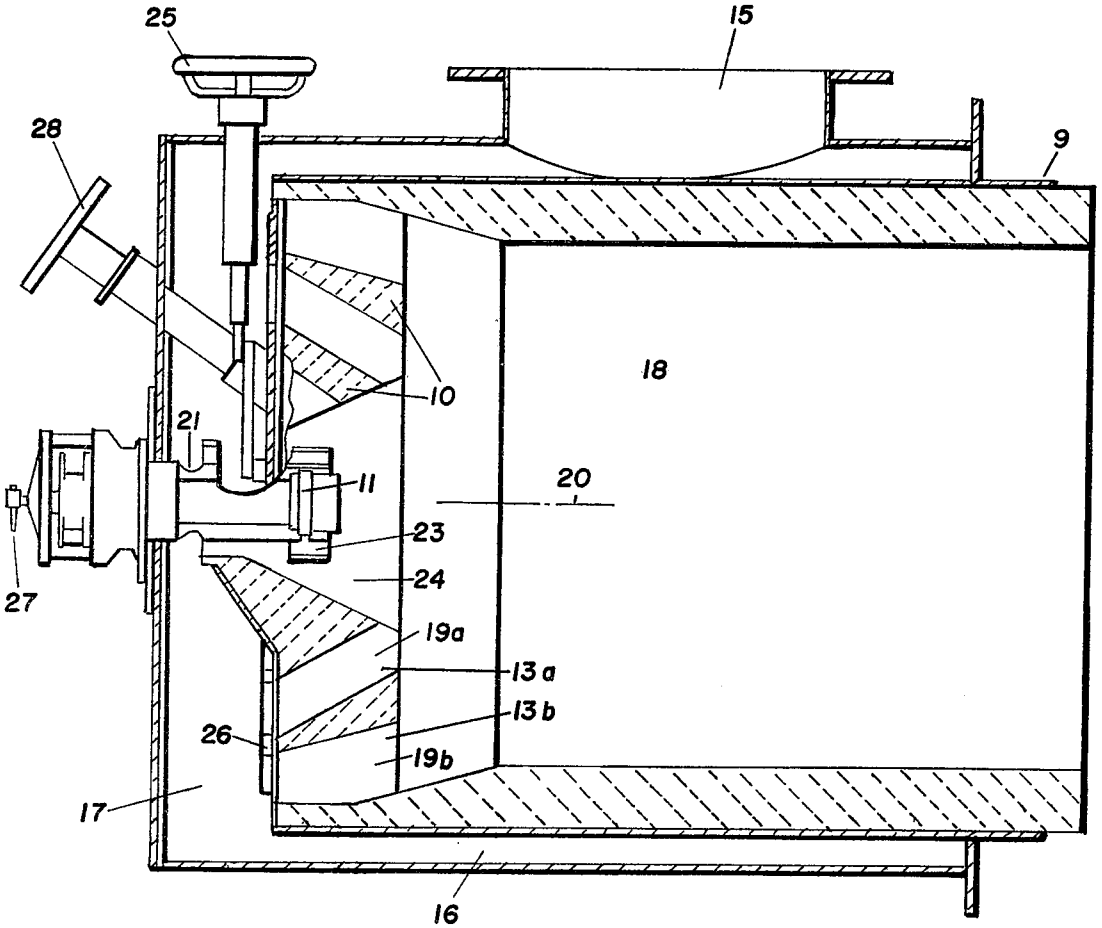

FIG. 3 shows a combustion chamber 9 magnified and in more detail. The fuel nozzle 11 is designed as an oil burner. The air flows from the connecting line 15 into the annular space 16 and the distributor space 17 and, in doing so, cools the exterior wall of the combustion chamber 9 and is heated. The air enters the combustion space 18 from the distributor space 17 as primary air through the swirl-arranged intake orifices 13*a* and as secondary air through the swirl-arranged intake orifices 13*b*. Axes 19*a* and 19*b* of the intake orifices 13*a* and 13*b*, due to the swirl arrangement, do not intersect with the central axis 20 of the combustion chamber 9. Cooling air flows through the annular space 21 of the fuel nozzle 11 and the swirl device 23 as well as through the conical space 24 into the combustion space 18. With the manually operated wheel 25 the rotating disc 26 can be moved. In this manner the air supply to any or all intake orifices 13*a* and 13*b* may be changed. As a result, the air supply to 21 and 24 is also changed. The oil is passed into the fuel nozzle 11 via pipeline 27.

Through windows in the extension opening the ignition and flame can be supervised.

In FIG. 3*a*, the fuel nozzle 11*a* is designed as a gas jet.

FIG. 4 illustrates various possibilities for the arrangement of the intake orifices 13*a* and 13*b* within the rear wall 10 in the circular sections *a* to *d*. The intake orifices 28*a* and 28*b*, located to the side of the distribution space 17, are drawn with a solid line and the discharge openings 29*a* and 29*b*, located to the side of the combustion space 18, are drawn with a dotted line.

It will thus be seen that the objects set forth above are efficiently attained.

We claim:

1. An apparatus for the ignition of solid fuel containing sinter mixtures on a sintering machine and in which a combustible fluid and an oxidizing fluid are introduced in a plurality of burners mounted in the sidewalls of a hood located over a portion of the sintering machine and wherein hot gases produced by the chemical action of said fluids in the burners are sucked from said hood through the sinter mixture, each of said burners having a cylindrical, horizontally disposed combustion chamber with a rear wall constructed of refractory material, a central feeding device extending through the rear wall of the combustion chamber for directing one of said fluids axially into the combustion chamber substantially along a central axis thereof, said rear wall having two rows of intake orifices for said second of said fluids arranged around the central feeding device in a circular pattern, and at least one row of which is oriented to direct the second of said fluids into the combustion chamber in a direction which extends radially and axially inward toward but circumferentially around the central axis of the combustion chamber wherein the improvement comprises at least one row of said intake orifices provided with a rotable disc by which said intake orifices can be sealed and reopened through rotation of said disc.

2. The apparatus according to claim 1 including a cylindrical casing closed at one end surrounding the combustion chamber and spaced therefrom to form an enclosed distributor space which extends annularly around the sidewalls of the combustion chamber and axially from the rear wall thereof and which communicates with said plurality of orifices, a pipeline which extends axially through the closed end of the casing and distributor space to deliver one of said fluids to said central feeding device and a line to introduce the other fluid into the annular portion of said distributor space to cool the combustion chamber while supplying fluid to said orifices.

3. An apparatus for the ignition of solid fuel containing sinter mixtures on a sintering machine and in which a combustible fluid and an oxidizing fluid are introduced in a plurality of burners mounted in the sidewalls of a hood located over a portion of the sintering machine and wherein hot gases produced by the chemical action of said fluids in the burners are sucked from said hood through the sinter mixture, each of said burners having a cylindrical horizontally disposed combustion chamber with a rear wall constructed of refractory material, a central feeding device extending through the rear wall of the combustion chamber for directing one of said fluids axially into the combustion chamber substantially along a central axis thereof, said rear wall having two rows of intake orifices for said second of said fluids arranged around the central feeding device in a circular pattern and at least one row of which is oriented to direct the second of said fluids into the combustion chamber in a direction which extends radially and axially inward toward but circumferentially around the central axis of the combustion chamber, a cylindrical casing closed at one end surrounding the combustion chamber and spaced therefrom to form an enclosed distributor space which extends annularly around the sidewalls of the combustion chamber and axially from the rear wall thereof and which communicates with said intake orifices, a pipeline which extends axially through the closed end of the casing and distributor space to deliver one of said fluids to said central feeding device and a line to introduce the second of said fluids into the annular portion of said distributor space to cool the combustion chamber while preheating said second fluid supplied to said intake orifices wherein the improvement comprises at least one row of said intake orifices provided with a rotatable disc by which said orifices can be sealed and reopened through rotation of said disc.

* * * * *